US010105270B2

(12) United States Patent
Macbeth

(10) Patent No.: US 10,105,270 B2
(45) Date of Patent: Oct. 23, 2018

(54) WATER BIRTHING APPARATUS

(71) Applicant: Matthew Macbeth, Brisbane (AU)

(72) Inventor: Matthew Macbeth, Brisbane (AU)

( * ) Notice: Subject to any disclaimer, the term of this patent is extended or adjusted under 35 U.S.C. 154(b) by 0 days.

(21) Appl. No.: 15/559,900

(22) PCT Filed: Mar. 18, 2016

(86) PCT No.: PCT/AU2016/000093

§ 371 (c)(1),
(2) Date: Sep. 20, 2017

(87) PCT Pub. No.: WO2016/149733

PCT Pub. Date: Sep. 29, 2016

(65) Prior Publication Data

US 2018/0092790 A1 Apr. 5, 2018

(30) Foreign Application Priority Data

Mar. 20, 2015 (AU) ..... 2015901008

(51) Int. Cl.
*A61G 7/10* (2006.01)
*A61G 15/00* (2006.01)
(Continued)

(52) U.S. Cl.
CPC ..... *A61G 7/1003* (2013.01); *A61G 15/005* (2013.01); *A61G 13/0009* (2013.01); *A61H 33/00* (2013.01)

(58) Field of Classification Search
CPC ..... A61G 7/1003; A61G 15/005
(Continued)

(56) References Cited

U.S. PATENT DOCUMENTS 2,187,283 A * 1/1940 Scheutz ..... A61G 7/1003 4/561.1
3,371,357 A 3/1968 Berthelson
4,091,478 A * 5/1978 Hardwick ..... A61G 7/1003 4/562.1

FOREIGN PATENT DOCUMENTS

JP H11-206842 A 8/1999
WO 2014016760 A1 1/2014

OTHER PUBLICATIONS

International Search Report for Priority Application PCT/AU2016/000093, dated May 30, 2016 (4 pages).
(Continued)

*Primary Examiner* — Tuan N Nguyen
(74) *Attorney, Agent, or Firm* — Abelman, Frayne & Schwab

(57) ABSTRACT

Water birthing apparatus for use in a bath sized to accommodate an adult woman in childbirth, the bath having a base wall and one or more side walls extending upwardly from the base wall to an upper edge to define an open top, including: a false floor sized to cover at least some of the base wall of the bath and including drainage means for draining water from above the false floor to below the false floor; and lifting means associated with the false floor and operable for moving the false floor between a lower position at which the false floor is adjacent or resting on the base wall and an elevated position spaced at which the false floor is spaced above the base wall, and wherein the lifting means includes a plurality of lifting arms connected to the false floor and extending from a movable carriage assembly mounted to a carriage track, the carriage assembly being movable up and down the carriage track.

11 Claims, 1 Drawing Sheet

(51) Int. Cl.
*A61H 33/00* (2006.01)
*A61G 13/00* (2006.01)

(58) Field of Classification Search
USPC ..... 4/560.1, 561.1, 573.1
See application file for complete search history.

(56) References Cited

OTHER PUBLICATIONS

International Preliminary Report on Patentability for Priority Application PCT/AU2016/000093, completion date Jul. 21, 2017 (12 pages).

* cited by examiner

WATER BIRTHING APPARATUS

THIS INVENTION relates to a water birthing apparatus. The invention has particular application birthing of human babies wherein the mother is immersed in water.

One of the options available to mothers giving birth is the so-called water birth in which the mother sits or lies somewhat recumbent in a bath of water. While the option has several benefits, there is an inherent risk involved, particularly if the situation of the mother requires medical staff to intervene, because the position of the mother in the bath restricts access of medical staff to the mother. Such a risk may dissuade mothers from choosing a water birth, thereby depriving themselves of the benefits of the option. Moreover, midwives and others assisting with the birth may actively discourage the mother from selecting a water birth because of the genuine risk involved should the mother require resuscitation or other medical attention.

The present invention aims to provide water birthing apparatus which ameliorates the risks associated with traditional water birthing such that water birthing may be reliable and efficient in use. Other aims and advantages of the invention may become apparent from the following description.

With the foregoing in view, the present invention in one aspect resides broadly in water birthing apparatus for use in a bath sized to accommodate an adult woman in childbirth, the bath having a base wall and one or more side walls extending upwardly from the base wall to an upper edge to define an open top, including:

a false floor sized to cover at least some of the base wall of the bath and including drainage means for draining water from above the false floor to below the false floor; and lifting means associated with the false floor and operable for moving the false floor between a lower position at which the false floor is adjacent or resting on the base wall and an elevated position spaced at which the false floor is spaced above the base wall.

In another aspect, the present invention resides broadly in water birthing apparatus including:

a bath sized to accommodate an adult woman in childbirth, the bath having a base wall and one or more side walls extending upwardly from the base wall to an upper edge to define an open top;

a false floor sized to cover at least some of the base wall and including drainage means for draining water from above the false floor to below the false floor; and lifting means associated with the false floor and operable for moving the false floor between a lower position at which the false floor is adjacent or resting on the base wall and an elevated position spaced at which the false floor is spaced above the base wall.

Preferably, the upper edge is substantially flat. More preferably, the upper edge is shaped for comfort of a mother entering and leaving the bath. In such form, it is preferred that the elevated position is such that the upper face of the false floor is substantially level with the upper edge of the side walls.

Preferably, the drainage means includes one or more perforations penetrating the false floor, and may further include an edge clearance between the edge of the false floor and the inside face of the one or more side walls. Preferably, the lifting means is structurally independent of the bath.

Preferably, the lifting means includes a plurality of lifting arms connected to the false floor and extending from a movable carriage assembly mounted to a carriage track, the carriage assembly being movable up and down the carriage track. In such form, the movement of the carriage assembly causes corresponding movement of the lifting arms and consequently, movement of the false floor.

In order that the invention may be more readily understood and put into practical effect, reference will now be made to the accompanying drawings which illustrate two embodiments of the invention, and wherein.

Figure 2:
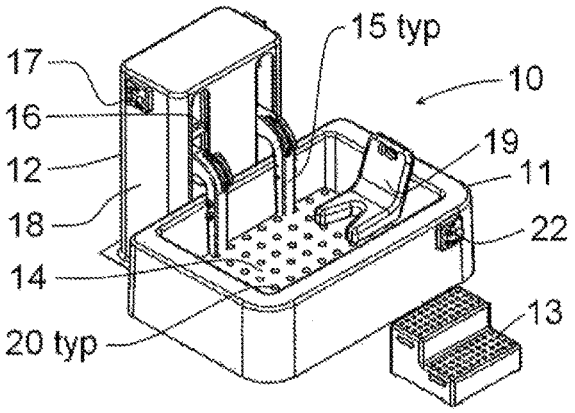
FIG. 2 is an isometric view of water birthing apparatus according to the invention and illustrating another embodiment.
Figure 3:
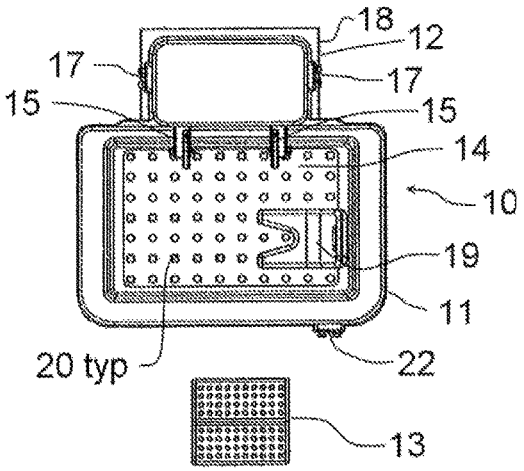
Figure 4:
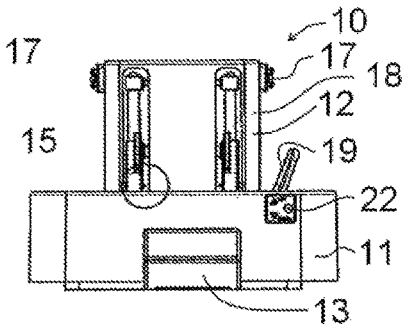
Figure 5:
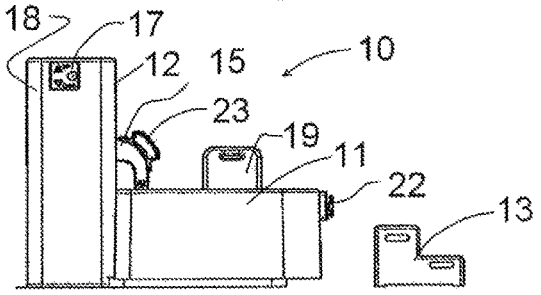

FIGS. 3, 4 and 5 constitute an orthographic projection of the water birthing apparatus of FIG. 2, FIG. 4 being a front elevation, FIG. 5 being an end elevation and FIG. 3 being a plan view.

Figure 1:
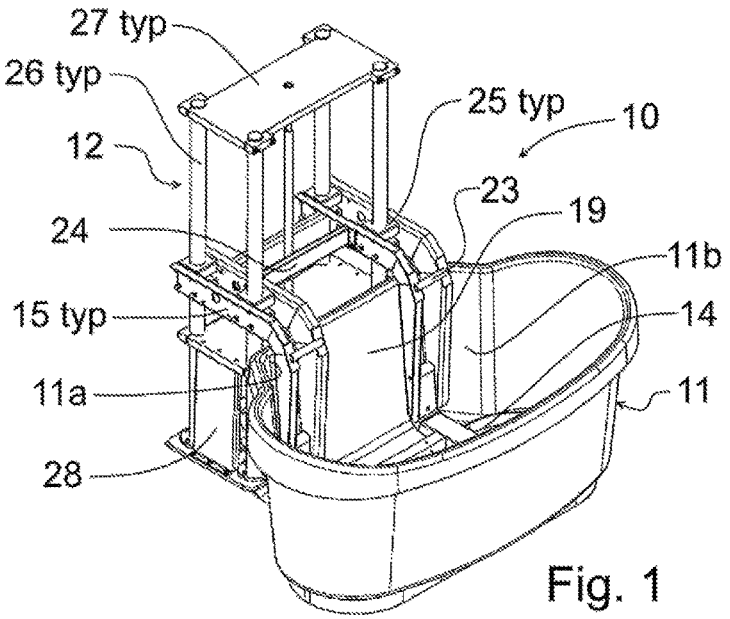
FIG. 1 is an isometric view of water birthing apparatus according to the invention and illustrating a preferred embodiment.

The water birthing apparatus 10 illustrated in FIG. 1 comprises a bath 11 and lifting apparatus 12. The bath is of oval form in plan view with the longer side of the oval adjacent the lifting apparatus. The bath has a base wall and a generally oval side wall extending upward from the periphery of the base wall. The top the side walls has a lip constituted by a flat surface of a width sufficient to allow a person to step or sit on in reasonable comfort.

The oval side wall slopes slightly outward from the vertical and includes a side recess extending outward from one of the longer sides of the bath. The portion of the side wall forming the recess is predominantly planar and slopes at similar angle from the vertical as the remainder of the side wall. For convenience, that portion of the side wall that forms the planar part of the recess will be referred to as the recess wall 11*a* and those portions of the side wall that joins the recess wall up the remaining part of the oval side wall will be referred to as the joining portions 11*b*. The lower end or edge of the recess wall is substantially straight and disposed outwardly from the remainder of the oval. In other words, the base of the side wall is substantially oval or elliptical with one of the long sides thereof being constituted by a line which is substantially straight, but disposed outwardly from the oval or ellipse. The joining portions are thus substantially in the form of a rectangle. Each part of the side wall is provided with rounded transitions from one portion to the other.

For convenience, the side of the bath adjacent the lifting apparatus will be referred to as the back, the side opposite thereto the front, and the left and right sides being defined when facing from the front to the back. The lifting apparatus includes a horizontal platform forming a false floor 14 which covers most of the base area of the bath. The false floor is supported by two support arms 15 which extend from a lift assembly 16. The lift assembly is moveable up and down, carrying with it the support arms and false floor under control of a set of controls (not shown in FIG. 1). The support arms to project forward from the lift assembly and then downward to the false floor.

A birthing chair 19 is mounted to face forward with its back in the recess when in the lowered position. The birthing chair is arranged to face to forward and has a backrest to the back which projects above the level of the lip of the bath when the false floor is in its lowered position at or close to the bottom of the bath. The birthing chair also has seat having an opening remote from the backrest.

The false floor has a plurality of perforations which penetrate therethrough and spaced regularly from one another in a square pattern. There is also a gap between the edges of the false floor and the inner faces of the sides wall of the bath. A secondary set of controls (not shown) is mounted to the outside of the front face of the bath for controlling the temperature of the water in the bath and/or the level of the false floor.

The support arms also have a grab handle 23 mounted to the outside of the rounded portion between the horizontal portion and the vertical portion.

The water birthing apparatus 10*a* illustrated in FIGS. 2 to 5 is the same in many respects as that illustrated and described with respect to FIG. 1. Accordingly, the same reference numerals are used to refer to the same elements of each embodiment illustrated as appropriate. A set of steps 13 is also provided for ease of access to and egress from the bath, and the steps may be used for the other embodiment of the bath illustrated in FIG. 1.

The bath of the other embodiment is of rectangular form with its vertical corners being rounded. The lift assembly is moved under control of a set of controls 17. The lifting apparatus has a cover 18 in the form of a rectangular prism having two wide slots in the face adjacent the bath for the support arms to project outward therefrom and then downward to the false floor. The cover hides the structure of the lift assembly and protects users from being caught up in the mechanism.

The birthing chair is mounted towards the front right corner of the upper face of the false floor in the other embodiment. The birthing chair is arranged to face to the left and has a backrest to the right which projects above the level of the lip of the bath when the false floor is in its low position at or close to the bottom of the bath. The birthing chair also has seat having an opening remote from the backrest.

The false floor has a plurality of perforations shown typically at 20 which penetrate therethrough. The perforations are spaced regularly from one another in a square pattern. There is also a gap 21 between the edges of the false floor and the inner faces of the sides walls of the bath. A secondary set of controls 22 is mounted to the outside of the front face of the bath for controlling the temperature of the water in the bath and/or the level of the false floor.

The support arms also have a grab handle 23 mounted to the outside of the rounded portion between the horizontal portion and the vertical portion. The lift assembly includes a frame having cross bars and sliding elements shown typically at 25 for sliding up and down slide four slide poles shown typically at 26 in FIG. 1, though it will be appreciated that a similar arrangement will be provided in the other embodiment illustrated in FIGS. 2 to 5. The slide poles are held in their substantially vertical orientation by three plates shown typically at 27, one at the top of the poles, one at the bottom, and the other intermediate thereto. The lower two plates also house the motor assembly 28 for driving the lift apparatus In use, the bath for the water birthing apparatus of the present invention is filled to a predetermined level with water which is set to a comfortable temperature. The mother takes herself into the bath at the appropriate stage of labour and, subject to there being no complications, gives birth to her baby in the bath in the normal manner of a water birth. The false floor may be raised for any reason, whether at the request of the mother for comfort or such like, or if a complication arises which would make it prudent to raise the mother out of the water. The bath may also include a water dump facility to quickly empty the bath of water.

Although the invention has been described with reference to one or more specific examples, it will be appreciated by those skilled in the art that the invention may be embodied in many other forms and fall within the broad scope and ambit of the invention as herein set forth and defined by the following claims.

The invention claimed is:

1. A water birthing apparatus for use in a bath sized to accommodate an adult woman in childbirth, the bath having a base wall and one or more side walls extending upwardly from the base wall to an upper edge to define an open top, including:

a false floor sized to cover at least some of the base wall of the bath and including an upper face and drainage means for draining water from above said false floor to below said false floor;

a birthing chair mounted to said upper face of said false floor; and lifting means associated with said false floor and operable for moving said false floor between a lower position at which said false floor is adjacent or resting on the base wall and an elevated position at which said false floor is spaced above the base wall, and wherein said lifting means includes a plurality of lifting arms connected to said false floor and extending from a movable carriage assembly mounted to a carriage track, said carriage assembly being movable up and down said carriage track.

2. The water birthing apparatus according to claim 1, wherein at least part of said lifting arms are extendible into said bath and the remainder of said arms and the remainder of said lifting means are located outside said bath.

3. The water birthing apparatus according to claim 2, wherein the movement of said carriage assembly causes corresponding movement of said lifting arms and consequently, movement of said false floor.

4. The water birthing apparatus according to claim 3, wherein said bath includes a recess into which said lifting arms extend for connection to said false floor.

5. A water birthing apparatus including:

a bath sized to accommodate an adult woman in childbirth, said bath having a base wall and one or more side walls extending upwardly from said base wall to an upper edge to define an open top;

a false floor sized to cover at least some of said base wall and including an upper face and drainage means for draining water from above said false floor to below said false floor;

a birthing chair mounted to said upper face of said false floor;

lifting means associated with said false floor and operable for moving said false floor between a lower position at which said false floor is adjacent or resting on said base wall and an elevated position at which said false floor is spaced above said base wall; and wherein said lifting means includes a plurality of lifting arms connected to said false floor and extending from a movable carriage assembly mounted to a carriage track, said carriage assembly being movable up and down said carriage track.

6. The water birthing apparatus according to claim 5, wherein said upper edge is substantially flat, being shaped for comfort of a mother entering and leaving said bath.

7. The water birthing apparatus according to claim 5, wherein said upper face of said false floor is substantially level with said upper edge of said side walls when said false floor is in said elevated position.

8. The water birthing apparatus according to claim 5, wherein said drainage means includes one or more perforations penetrating said false floor.

9. The water birthing apparatus according to claim 5, wherein said drainage means includes an edge clearance between said edge of said false floor and the inside face of said one or more side walls.

10. The water birthing apparatus according to claim 5, wherein said lifting means is structurally independent of said bath.

11. The water birthing apparatus according to claim 5, and including emergency operation means linking said lifting means and said drainage means for draining the bath and lifting said false floor at a predetermined rate, the predetermined rate being sufficient to permit a patient extracted from said bath in time to perform emergency medical procedures on a patient who is supported on said false floor.

* * * * *